US009887464B2

(12) United States Patent
Park et al.

(10) Patent No.: US 9,887,464 B2
(45) Date of Patent: Feb. 6, 2018

(54) COMPACT DIPOLE ANTENNA FOR RFID TAG

(71) Applicant: AJOU UNIVERSITY INDUSTRY-ACADEMIC COOPERATION FOUNDATION, Suwon-si, Gyeonggi-do (KR)

(72) Inventors: Ikmo Park, Yongin-si (KR); Tran Huy Hung, Suwon-si (KR)

(73) Assignee: AJOU UNIVERSITY INDUSTRY-ACADEMIC COOPERATION FOUNDATION, Suwon-si (KR)

( * ) Notice: Subject to any disclaimer, the term of this patent is extended or adjusted under 35 U.S.C. 154(b) by 138 days.

(21) Appl. No.: 15/171,670

(22) Filed: Jun. 2, 2016

(65) Prior Publication Data

US 2017/0117634 A1 Apr. 27, 2017

(30) Foreign Application Priority Data

Oct. 22, 2015 (KR) ..... 10-2015-0147348
Jan. 29, 2016 (KR) ..... 10-2016-0011573

(51) Int. Cl.
*H01Q 1/22* (2006.01)
*H01Q 9/28* (2006.01)

(52) U.S. Cl.
CPC ..... *H01Q 9/285* (2013.01); *H01Q 1/2225* (2013.01)

(58) Field of Classification Search
CPC H01Q 9/285; H01Q 9/26; H01Q 9/44; H01Q 1/22
USPC ..... 343/793–798; 340/570.7
See application file for complete search history.

(56) References Cited

U.S. PATENT DOCUMENTS 4,860,019 A * 8/1989 Jiang ..... H01Q 1/38 343/795
5,986,609 A * 11/1999 Spall ..... H01Q 1/243 343/700 MS
7,501,955 B2 * 3/2009 Forster ..... G06K 19/07749 340/572.7
8,264,357 B2 * 9/2012 Kato ..... G06K 19/07749 340/572.5

FOREIGN PATENT DOCUMENTS

KR 10-2011-0020617 A 3/2011

* cited by examiner

*Primary Examiner* — Dameon E Levi
*Assistant Examiner* — Hasan Islam
(74) *Attorney, Agent, or Firm* — Stein IP, LLC

(57) ABSTRACT

Provided is a compact dipole antenna for a radio frequency identification (RFID) tag. The antenna includes a substrate, a dipole radiator including a first dipole element and a second dipole element, in each of which a first meander line formed in a meandering shape and an arm configured of a triangular pattern which is an end connected to the first meander line, are arranged to face each other, wherein the first and second dipole elements are arranged on the substrate to be perpendicular to each other, and an impedance matcher, which includes a second meander line formed in a meandering shape, is formed at a point at which the first and second dipole elements are perpendicular to each other, and performs an impedance matching between the antenna and an RFID tag chip through the second meander line.

11 Claims, 5 Drawing Sheets

(a)

(b)

COMPACT DIPOLE ANTENNA FOR RFID TAG

CROSS-REFERENCE TO RELATED APPLICATION

This application claims priority to and the benefit of Korean Patent Application No. 10-2015-0147348, filed on Oct. 22, 2015 and Korean Patent Application No. 10-2016-0011573, filed on Jan. 29, 2016 the disclosures of which are incorporated herein by reference in its entirety.

BACKGROUND

1. Field of the Invention

The present invention relates to a dipole antenna, and more particularly, to a compact dipole antenna for a radio frequency identification (RFID) tag capable of being used in an RFID-ultra high frequency (UHF) band, easily performing a conjugate impedance matching between an antenna and an RFID tag chip and miniaturization, and increasing a reading distance and a received power by generating circular polarization.

2. Discussion of Related Art

Generally, radio frequency identification (RFID), which is a technique in which information included in a tag is detected and recorded using a radio frequency in a non-contact method, is a technique capable of detecting, tracing, and managing a tagged object, animal, person, and the like.

An RFID system includes a tag (or a transponder) having unique identification information that is attached to an object, an animal, or the like, and a reader (or an interrogator) for reading or recording the identification information included in the tag.

Generally, the RFID tag is configured of an integrated circuit (IC) chip, and an antenna, an RF transceiving circuit, a control logic, and a memory are embedded in the IC chip, and a radio frequency is transceived through the antenna.

The RFID tag reflects a signal in a specific RF band transmitted from the reader, changes information including the identification information in the reflected RF signal, and transmits the RF signal to the reader.

The antenna used in the RFID tag has a dipole antenna pattern printed on a film. That is, a characteristic of the antenna applied to the RFID tag is designed in a pattern shape of the dipole antenna.

However, the antenna used in the RFID tag generates linear polarization (LP), and thus only half of a transmission power is received by the tag due to a polarization mismatch phenomenon between the reader, which generally generates circular polarization, and the tag. As a result, there is a problem that a maximum reading range of the antenna is reduced.

Related art of Korea Unexamined Patent Application Publication No. 10-2011-0020617 (Title: CIRCULARLY POLARIZED ANTENNA FOR UHF BAND RFID READER, Published on Mar. 3, 2011) exists.

SUMMARY OF THE INVENTION

The present invention is directed to a compact dipole antenna for a radio frequency identification (RFID) tag capable of being used in an RFID-ultra high frequency (UHF) band, easily performing a conjugate impedance matching between an antenna and an RFID tag chip and miniaturization, and increasing a reading distance and a received power by generating circular polarization (CP).

The scope of the present invention is not limited to the above-described object(s), and other unmentioned object(s) may be clearly understood by those skilled in the art from the following descriptions.

According to an aspect of the present invention, there is provided a compact dipole antenna for an RFID tag including a substrate, a dipole radiator including a first dipole element and a second dipole element, in each of which a first meander line formed in a meandering shape and an arm configured of a triangular pattern which is an end connected to the first meander line, are arranged to face each other, wherein the first and second dipole elements are arranged on the substrate to be perpendicular to each other, and an impedance matcher, which includes a second meander line formed in a meandering shape, is formed at a point at which the first and second dipole elements are perpendicular to each other, and performs an impedance matching between the antenna and an RFID tag chip through the second meander line.

In the first meander line, at least one of a number of turns representing a degree of meanders, a distance, and a thickness may be adjusted.

An intermediate portion of the second meander line may be connected to the RFID tag chip and the impedance matcher may perform the impedance matching.

In the impedance matcher, a length of the second meander line corresponding to a required input impedance value of the antenna may be adjusted perform the impedance matching.

The impedance matcher may be configured to match the required input impedance value of the antenna to a complex conjugate of the input impedance of the RFID tag chip through the adjustment of the length of the second meander line.

The antenna may further include a phase difference generator, which connects the arm of the first dipole element to the arm of the second dipole element and is formed in a semi-circular ring shape.

In the phase difference generator, inner arcs of the semi-circular ring may be arranged to face each other at diagonal positions.

The phase difference generator may generate CP based on a phase difference of a feeding signal by the semi-circular ring shape.

When a phase of the feeding signal is 0 degrees, a current of the feeding signal may flow from a right side of a dipole element of the first and second dipole elements arranged in a horizontal direction to a left side via the impedance matcher, and may be divided into two paths formed with the second meander line formed on an upper portion of the impedance matcher and a straight line formed on a lower portion thereof.

When the phase of the feeding signal is 90 degrees, the current of the feeding signal may flow from an upper side of a dipole element of the first and second dipole elements arranged in a vertical direction to a lower side via the phase difference generator and the impedance matcher, and flow to the second meander line, which is a path formed on an upper portion of the impedance matcher, and a straight line, which is a path formed on a lower portion of the impedance matcher, in opposite directions to each other.

The substrate may be a rectangular dielectric substrate having a predetermined permittivity.

Details of other embodiments are included in the detailed description and the accompanying drawings.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Advantages and features of the present invention and methods of accomplishing them will be made apparent with reference to the accompanying drawings and embodiments to be described below. The present invention may, however, be embodied in various different forms, and should be construed as limited, not by the embodiments set forth herein, but only by the accompanying claims. Rather, these embodiments are provided so that this disclosure is thorough and complete and fully conveys the present invention to those skilled in the art. The same reference symbols denote the same components throughout the specification.

Hereinafter, embodiments of the present invention will be described in detail with reference to the accompanying drawings.

Figure 1:
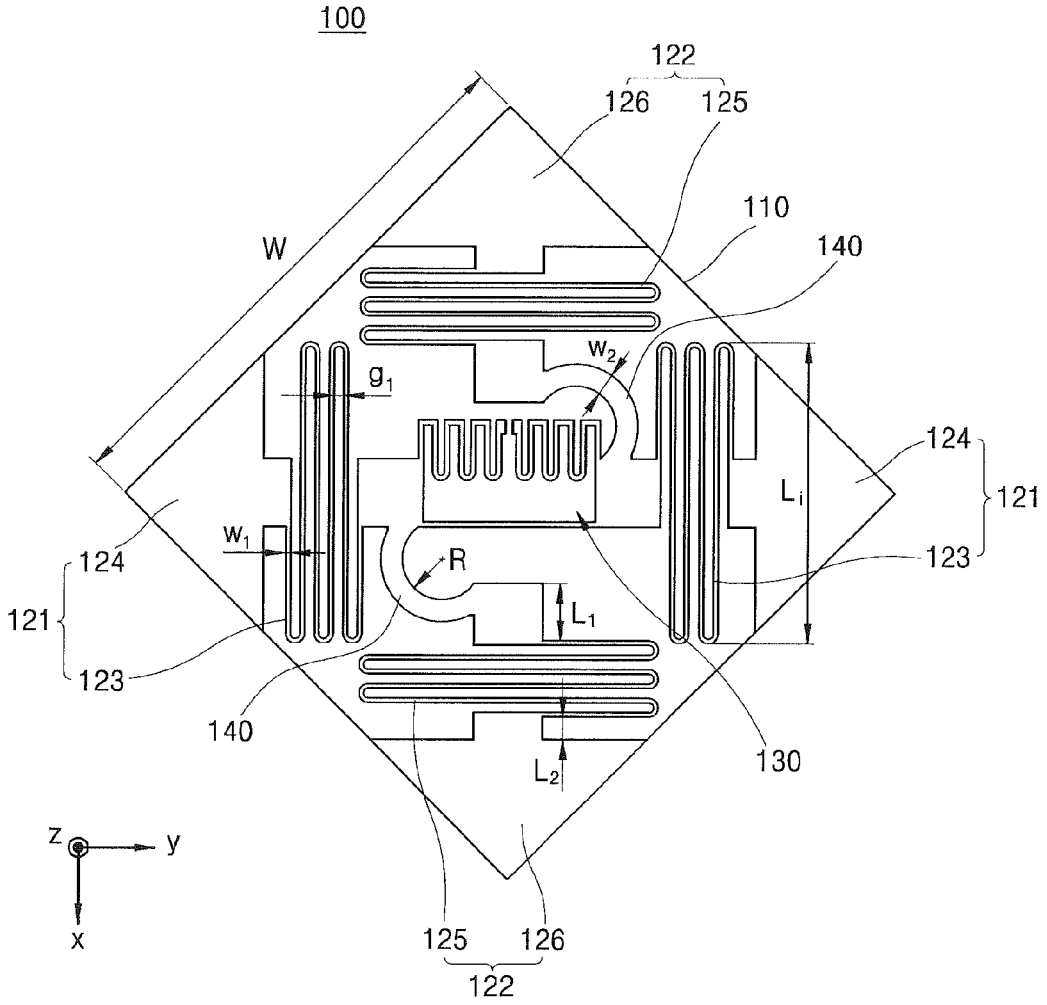
FIG. 1 is a view illustrating a compact dipole antenna for a radio frequency identification (RFID) tag according to an embodiment of the present invention.
Figure 2:
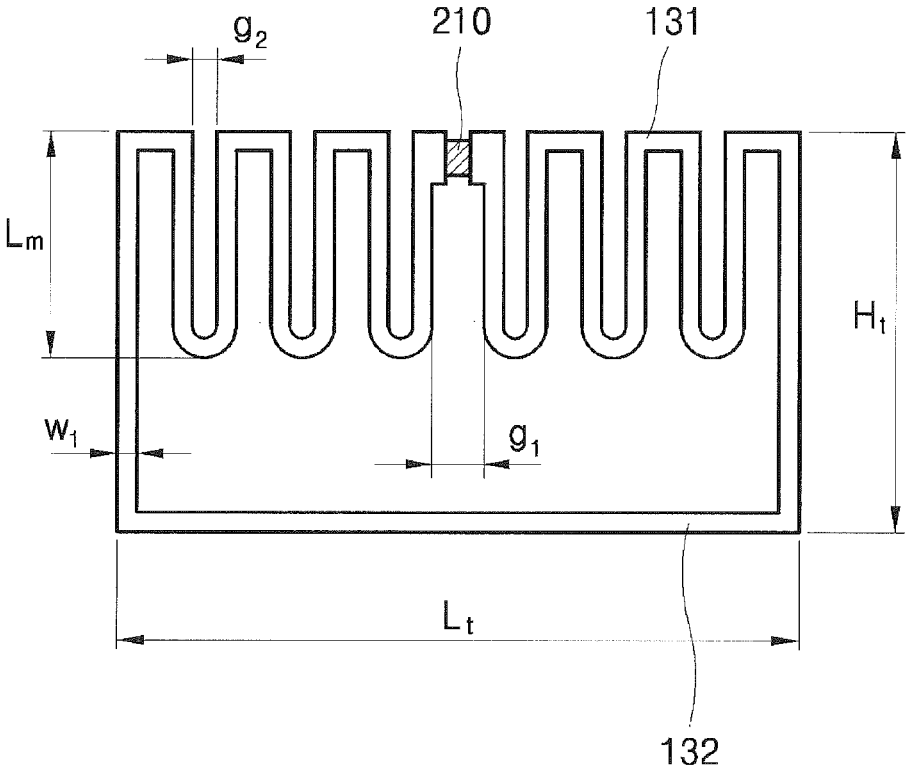
FIG. 2 is a view illustrating an impedance matcher of FIG. 1 in detail.

FIG. 1 is a view illustrating a compact dipole antenna for a radio frequency identification (RFID) tag according to an embodiment of the present invention, and FIG. 2 is a view illustrating an impedance matcher of FIG. 1 in detail.

As illustrated in FIGS. 1 and 2, a compact dipole antenna for the RFID tag 100 according to the embodiment of the present invention may include a substrate 110, dipole radiators 121 and 122, an impedance matcher 130, and a phase difference generator 140.

The substrate 110, which is a dielectric substrate having a predetermined permittivity, may be formed in a rectangular shape. That is, the substrate 110 may be formed in a cubic plate shape.

In this case, the substrate 110 may be implemented with a Rogers RO4003 substrate of which a permittivity is 3.38, a loss tangent is 0.0027, and a thickness is 0.508 mm. However, the substrate 110 is not limited thereto, and may also be formed with various substrates, for example, a substrate of a silicon material having high permittivity.

As the substrate 110 is formed of a material having high permittivity as described above, a feeding signal introduced from a feed (not illustrated) may be actively transferred, and at the same time, a small-sized antenna may be implemented by reducing a size of the antenna.

The dipole radiators 121 and 122 may include first dipole elements 121 and second dipole elements 122, which are arranged on the substrate 110 to be perpendicular to each other.

Here, the first dipole elements 121 and the second dipole elements 122, in each of which first meander lines 123 and 125 formed in a meandering shape and an arm of triangular patterns 124 and 126 which are ends connected to the first meander lines 123 and 125, may be arranged to face each other.

The first meander line 123 may adjust at least one of a number of turns representing a degree of meanders, a distance, and a thickness, thereby reducing the size of the antenna, miniaturizing the antenna, and improving the characteristics of the antenna.

The triangular pattern 124 may radiate a signal having a predetermined pattern transferred through the first meander line 123 to the outside.

The impedance matcher 130 may be formed at a point at which the first and second dipole elements 121 and 122 of the dipole radiators 121 and 122 are perpendicular to each other.

The impedance matcher 130 may include an upper line of a second meander line 131 formed in a meandering shape and a lower line of a straight line 132 arranged under the second meander line 131 to be spaced apart by a predetermined distance.

The impedance matcher 130 performs impedance matching between the antenna and an RFID tag chip 210 through the second meander line 131. Here, as illustrated in FIG. 2, the RFID tag chip 210 may be formed to be connected to an intermediate portion of the second meander line 131, and thus the impedance matcher 130 may perform the impedance matching between the antenna and the RFID tag chip 210 through the second meander line 131.

In order to perform the impedance matching, the impedance matcher 130 may adjust a length of the second meander line 131 corresponding to a required input impedance value of the antenna.

That is, the impedance matcher 130 may be configured so that the required input impedance value of the antenna is matched to a complex conjugate of an input impedance of the RFID tag chip 210 by adjusting the length of the second meander line 131.

For example, when the RFID tag chip 210 has an input impedance of 24-j195 at 915 MHz, the input impedance of the compact dipole antenna for the RFID tag 100 should need to be close to 24+j195 in order to perform the complex conjugate matching between the RFID tag chip 210 and the antenna. In the present embodiment, the input impedance of the antenna may be easily adjusted using the impedance matcher 130.

As described above, according to the embodiment of the present invention, as the input impedance of the antenna is easily adjusted through the second meander line 131 of the impedance matcher 130, the antenna may be miniaturized by reducing the size thereof through the second meander line 131, and the conjugate impedance matching between the antenna and the RFID tag chip 210 may be easily performed.

The phase difference generator 140 may connect the arm of the first dipole element 121 to an arm of the second dipole element 122, and generate circular polarization (CP) by being formed in a semi-circular ring shape.

In this case, in the phase difference generator 140, inner arcs of the semi-circular ring may be arranged to face each other at diagonal positions.

Because the phase difference generator 140 is formed in the semi-circular ring shape, the phase difference generator 140 may generate a phase difference of the feeding signal. Thus, the phase difference generator 140 may generate CP based on the phase difference of the feeding signal.

In this case, a flow direction of a current of the feeding signal may be changed according to the phase of the feeding signal. Hereinafter, current distributions of the feeding signal in two cases in which the phases of the feeding signal are 0 degrees and 90 degrees will be described in detail with reference to FIG. 3.

Figure 3:
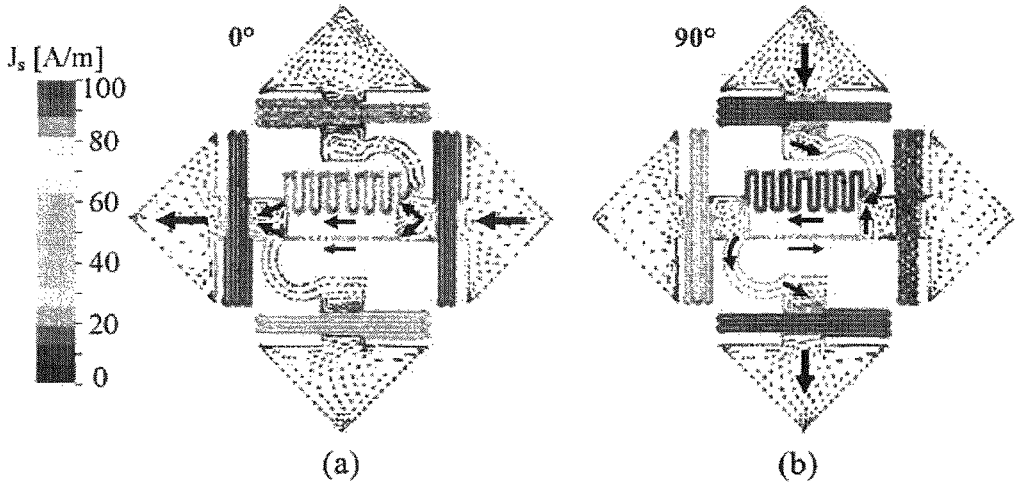
FIG. 3 is a view illustrating a distribution of a current of a feeding signal according to a phase difference in the embodiment of the present invention.

First, as illustrated in FIG. 3(*a*), when the phase of the feeding signal is 0 degrees, the current of the feeding signal flows from a right side of the first dipole element 121, which is a dipole element arranged in a horizontal direction, to a left side thereof via the impedance matcher 130.

In this case, in the impedance matcher 130, the current of the feeding signal is divided into two paths formed with the second meander line 131, which is the upper line, and the straight line 132, which is the lower line.

In other words, the current of the feeding signal starts to flow from the right side of the first dipole element 121, is divided into the two paths of the second meander line 131 and the straight line 132 when passing through the impedance matcher 130, and then joins and flows to the left side of the first dipole element 121.

Meanwhile, as illustrated in FIG. 3(*b*), when the phase of the feeding signal is 90 degrees, the current of the feeding signal flows from an upper side of the second dipole element 122 arranged in a vertical direction to a lower side thereof via the phase difference generator 140 and the impedance matcher 130.

In this case, the current of the feeding signal flows to the second meander line 131 and the straight line 132 of the impedance matcher 130 in opposite directions to each other.

That is, the current of the feeding signal starts to flow from the upper side of the second dipole element 122, passes through the phase difference generator 140 and the impedance matcher 130, and then flows to the lower side of the second dipole element 122. When passing through the impedance matcher 130, the current of the feeding signal flows to the second meander line 131 in a left direction, and flows to the straight line 132 in a right direction.

Therefore, referring to FIG. 3, in the second meander line 131 of the impedance matcher 130, it may be seen that the distribution of the current of the feeding signal is better when the phase is 90 degrees compared to when the phase is 0 degrees.

Meanwhile, optimized design parameters of the compact dipole antenna for the RFID tag 100 are as follows. W=35.6 mm, $L_1$=4 mm, $L_2$=1 mm, $L_i$=19.7 mm, R=3.2 mm, $w_1$=0.4 mm, $w_2$=1.6 mm, $g_1$=1 mm, $g_2$=0.6 mm, $L_t$=14 mm, $H_t$=8 mm, and $L_m$=4.2 mm.

Figure 4:
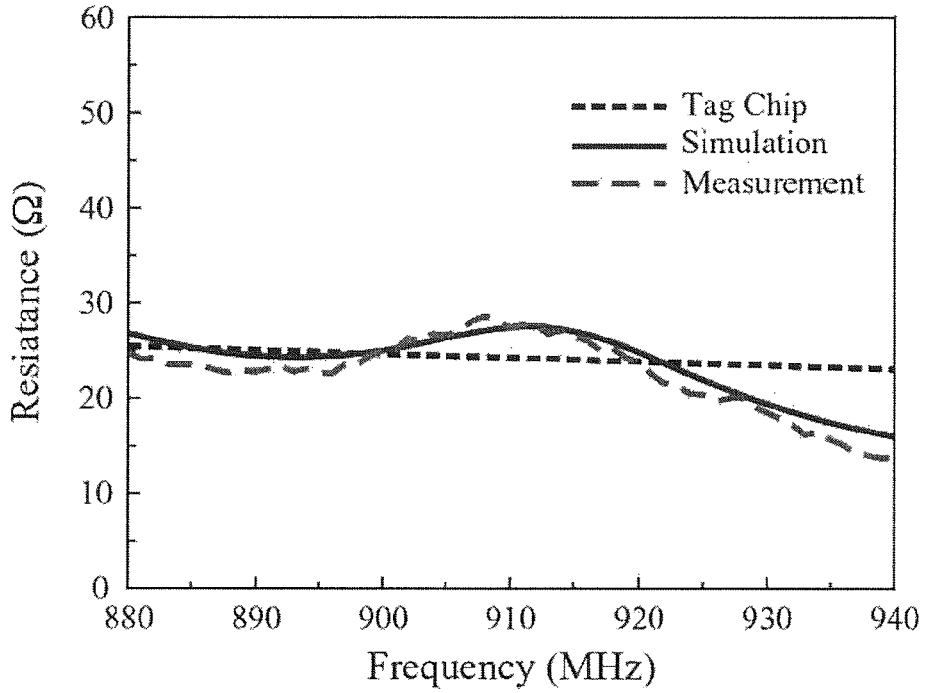
FIG. 4 is a graph illustrating simulation and measurement results with respect to the input impedance of the compact dipole antenna for the RFID tag according to the embodiment of the present invention.
Figure 4:
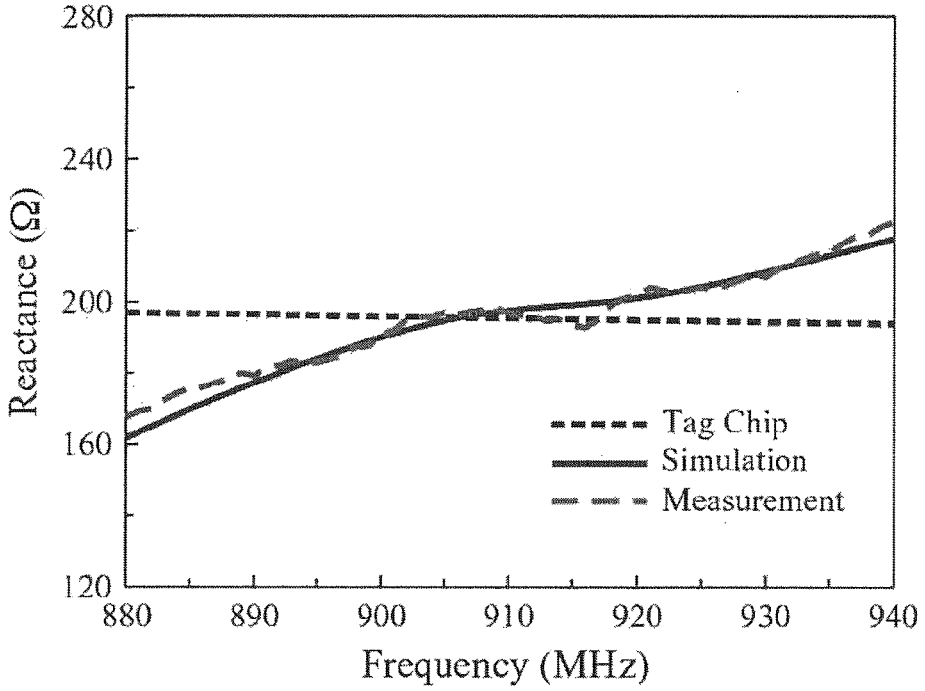

FIG. 4 is a graph illustrating simulation and measurement results with respect to the input impedance of the compact dipole antenna for the RFID tag according to the embodiment of the present invention Referring to FIG. 4, it may be confirmed that a good conjugate matching is performed between the antenna and the RFID tag chip. Specifically, it may be confirmed that a resistance component (see FIG. 4(*a*)) and a reactance component (see FIG. 4(*b*)) of the antenna are very close to those of the RFID tag chip in the 890-925 MHz frequency range.

These results indicate that the antenna of the present invention has a good impedance matching bandwidth. This may be confirmed in FIG. 5.

Figure 5:
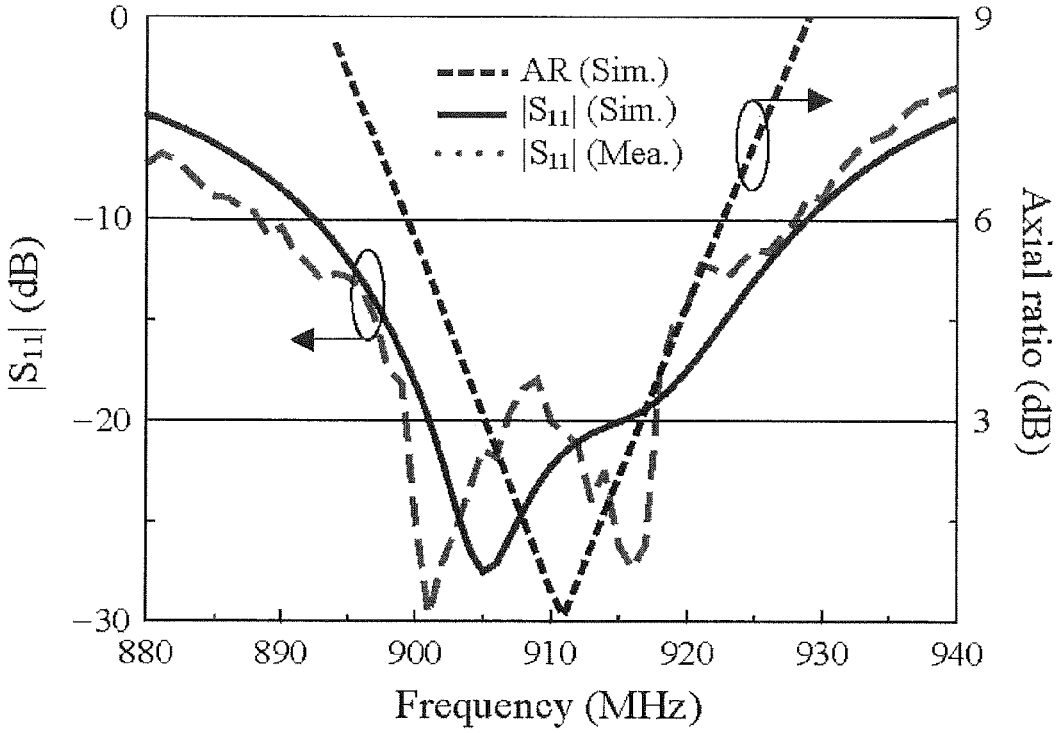
FIG. 5 is a graph illustrating simulated and measured reflection coefficients $|S_{11}|$ each obtained from the simulation and measurement results with respect to the input impedance of the antenna of the present invention.

FIG. 5 is a graph illustrating simulated and measured reflection coefficients $|S_{11}|$ respectively obtained from the simulation and measurement results with respect to the input impedance of the antenna of the present invention A value of the reflection coefficients $|S_{11}|$ was determined using the following Equation 1.

$$|S_{11}| = -20\log\left|\frac{Z_a - Z_c^*}{Z_a + Z_c}\right| \quad \text{[Equation 1]}$$

Here, $Z_a$ and $Z_c$ are input impedances of the antenna and the RFID tag chip, respectively.

It may be confirmed that a band of 37 MHz (892-929 MHz) was obtained when the reflection coefficients was −10 dB according to the simulation results, whereas a band of 39 MHz (890-929 MHz) was obtained when the reflection coefficients was −10 dB according to the measurement results.

Figure 6:
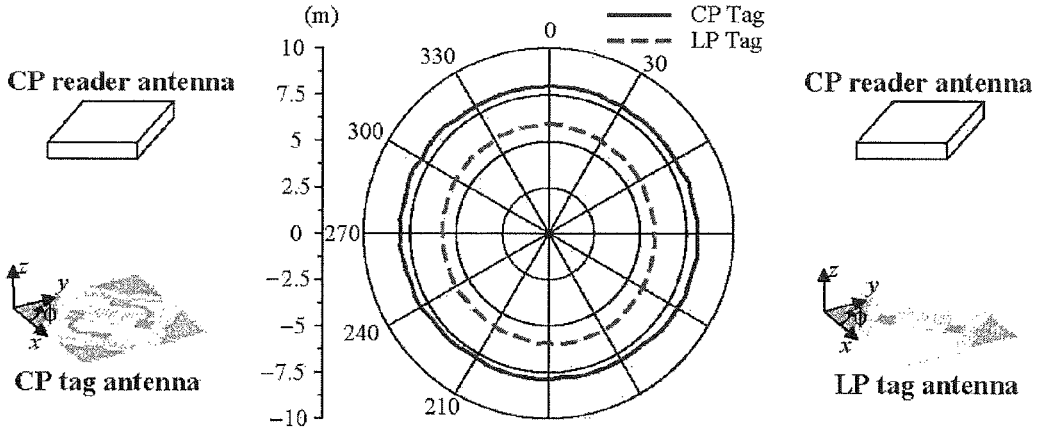
FIG. 6 is a view illustrating results of measuring reading ranges using a linear polarization (LP) tag antenna and a circular polarization (CP) tag antenna.

FIG. 6 is a view illustrating results measuring reading ranges using a linear polarization (LP) tag antenna and a CP tag antenna.

As illustrated in FIG. 6, it may be confirmed that a maximum readable distance of the CP tag antenna was more excellent than that of the LP tag antenna. In other words, the CP tag antenna generated CP and the LP tag antenna generated LP. It may be seen that a reading distance of 7.7 m of the CP tag antenna is greater than that of 5.7 m of the LP tag antenna.

According to the embodiment of the present invention, the compact dipole antenna for the RFID tag can be used in an RFID-ultra high frequency (UHF) band, can easily perform a conjugate impedance matching between an antenna and an RFID tag chip and miniaturization, and can increase a reading distance and a received power by generating CP.

While the present invention has been described above in detail with reference to representative embodiments, it may be understood by those skilled in the art that the embodiment may be variously modified without departing from the scope of the present invention. Therefore, the scope of the present invention is defined not by the described embodiment but by the appended claims, and encompasses equivalents that fall within the scope of the appended claims.

As described above, while the present invention has been described with reference to specific embodiments and drawings, the present invention is not limited thereto. It should be apparent by those skilled in the art that various modifications and alterations may be made without departing from the spirit and scope of the present invention and equivalents of the appended claims. Therefore, the spirit of the invention should be identified only by the scope of the appended claims, and encompasses all modifications and equivalents that fall within the scope of the appended claims.

What is claimed is:

1. A compact dipole antenna for a radio frequency identification (RFID) tag, the antenna comprising:

a substrate;

a dipole radiator including a first dipole element and a second dipole element, in each of which a first meander line formed in a meandering shape and an arm configured of a triangular pattern which is an end connected to the first meander line and, are arranged to face each other, wherein the first and second dipole elements are arranged on the substrate to be perpendicular to each other; and an impedance matcher including a second meander line formed in a meandering shape, formed at a point at which the first and second dipole elements are perpendicular to each other, and configured to perform an impedance matching between the antenna and an RFID tag chip through the second meander line.

2. The antenna of claim 1, wherein in the first meander line, at least one of a number of turns representing a degree of meanders, a distance, and a thickness is adjustable.

3. The antenna of claim 1, wherein an intermediate portion of the second meander line is connected to the RFID tag chip and the impedance matcher performs the impedance matching.

4. The antenna of claim 3, wherein in the impedance matcher, a length of the second meander line corresponding to a required input impedance value of the antenna is adjusted to perform the impedance matching.

5. The antenna of claim 4, wherein the impedance matcher is configured to match the required input impedance value of the antenna to a complex conjugate of an input impedance of the RFID tag chip through the adjustment of the length of the second meander line.

6. The antenna of claim 1, further comprising a phase difference generator configured to connect the arm of the first dipole element to the arm of the second dipole element and formed in a semi-circular ring shape.

7. The antenna of claim 6, wherein in the phase difference generator, inner arcs of the semi-circular ring are arranged to face each other at diagonal positions.

8. The antenna of claim 6, wherein the phase difference generator generates circular polarization (CP) based on a phase difference of a feeding signal by the semi-circular ring shape.

9. The antenna of claim 8, wherein, when a phase of the feeding signal is 0 degrees, a current of the feeding signal flows from a right side of a dipole element of the first and second dipole elements arranged in a horizontal direction to a left side via the impedance matcher, and is divided into two paths formed with the second meander line formed on an upper portion of the impedance matcher and a straight line formed on a lower portion thereof.

10. The antenna of claim 8, wherein, when a phase of the feeding signal is 90 degrees, a current of the feeding signal flows from an upper side of a dipole element of the first and second dipole elements arranged in a vertical direction to a lower side via the phase difference generator and the impedance matcher, and flows to the second meander line, which is a path formed on an upper portion of the impedance matcher, and a straight line, which is a path formed on a lower portion of the impedance matcher, in opposite directions to each other.

11. The antenna of claim 1, wherein the substrate is a rectangular dielectric substrate having a predetermined permittivity.

* * * * *